United States Patent [19]

Trafton

[11] Patent Number: 4,844,443

[45] Date of Patent: Jul. 4, 1989

[54] SIMPLIFIED REGISTRATION GATE

[75] Inventor: R. Winfield Trafton, Holley, N.Y.

[73] Assignee: Eastman Kodak Company, Rochester, N.Y.

[21] Appl. No.: 108,884

[22] Filed: Oct. 16, 1987

[51] Int. Cl.[4] ..... B65H 9/06

[52] U.S. Cl. ..... 271/245; 271/253

[58] Field of Search ..... 271/242, 245, 246, 253

[56] References Cited

U.S. PATENT DOCUMENTS

| | | | |
|---|---|---|---|
| 4,019,732 | 4/1977 | Hunt, Jr. | 271/245 |
| 4,019,733 | 4/1977 | Montalto | 271/245 |
| 4,436,404 | 3/1984 | Simmons | 271/246 X |
| 4,473,222 | 9/1984 | Simmons | 271/245 |

OTHER PUBLICATIONS

Drawing of a registration gate assembly that has been in use for more than a year in the Kodak Ektaprint Duplicator Model 250.

*Primary Examiner*—Richard A. Schacher
*Attorney, Agent, or Firm*—Tallam I. Nguti

[57] ABSTRACT

A sheet feeding and registration assembly has a finger for intercepting sheets for registration. An integral friction mounting member attaches the finger to a shaft, and a portion of the mounting member is radially urged toward the shaft so that the finger can selectively rotate with the shaft or slip relative to the shaft.

6 Claims, 2 Drawing Sheets

SIMPLIFIED REGISTRATION GATE

BACKGROUND OF THE INVENTION

This invention relates to a simplified registration gate for selectively registering sheets fed seriatim in reproduction equipment such as a copier/duplicator or printer.

In high speed reproduction equipment, it is a general practice to make copies on individual sheets of material that are either cut from a web into desired sizes or located in a hopper. The sheets are fed seriatim and advanced along a travel path and into contact with an image bearing surface on a plate or web. The image is then transferred to the sheet and subsequently fused to the sheet. Since the image bearing surface may also be moving relative to the path of the individual sheet, the movement of the sheet must be synchronized and coordinated with the movement of the surface to insure correct registration for the image transfer.

Various types of sheet registration assemblies are well known in the art. For example, U.S. Pat. Nos. 4,019,732 and 4,019,733 disclose mechanisms for registering a copy sheet in reproduction equipment. The mechanisms described in these patents comprise a sheet travel path, means for advancing or urging the sheets along the path, and a registration device located on a hub that is mounted on a shaft and having at least a registration finger. The registration device is located on the hub between two rollers but interspaced from the rollers by thrust washers, so as to maintain an axial loading force on the registration device through the rollers. Each such mechanism consists of at least six separate components interacting and cooperating with each other and with the shaft.

Other known registration mechanisms have multiple interacting components. Typically, such mechanisms comprise a disc with a registration finger that is mounted on a hub (on a shaft) between two other discs, interacting with a pressure plate and a compressed spring on a support, to axially load the registration disc against a sheet feeding roller. Such multiple interacting component mechanisms that rely on axial loading against the sheet feeding rollers may be costly to assemble, difficult to adjust, and can be unreliable because of the axial loading. These disadvantages of the prior art are even more of a problem in high speed reproduction equipment that must also produce high quality copies. Such equipment requires a registration assembly with a registration gate that is easy to adjust but is accurate and reliable after adjustment, and a registration gate that is free of undesirable axial forces, and of the likelihood of component failure.

SUMMARY OF THE INVENTION

It is, therefore, the object of this invention to provide, in a registration assembly, a registration gate that places no undesirable axial forces on the sheet feeding rollers, thereby preserving the adjustment and accuracy of such rollers. It is a further object of this invention to simplify the design and assembly of the registration gate by reducing the number of interacting components required to enable the gate to function properly within the registration assembly, and thus reduce the cost of manufacture and assembly of the gate. Another object is to provide a gate that is easily mounted onto and removed from a shaft.

In accordance with the present invention, a single component registration gate is mountable to a drive shaft and adjacent to, but not in contact with, sheet feeding rollers also on the shaft. The registration gate has a finger for selectively intercepting a sheet being advanced along a path, mounting means integral with the finger for mounting the gate to the shaft, and means for frictionally engaging the mounting means to the shaft with a radial force sufficient to urge the gate to rotate with the shaft when the finger is unlatched and free to rotate with the shaft. The magnitude of the radial force is also such as to allow the mounting means (and thus the entire gate) to slip relative to the shaft when the finger is prevented from rotating with the shaft either by the latching means or by a sheet being fed by the sheet feeding rollers. The present invention accomplishes this sheet registration function within the registration assembly without inducing any axial (and thus undesirable) forces to the sheet feeding rollers. The invention and its objects and advantages will become even more apparent in the detailed description of the preferred embodiment presented below.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENTS

Figure 1:
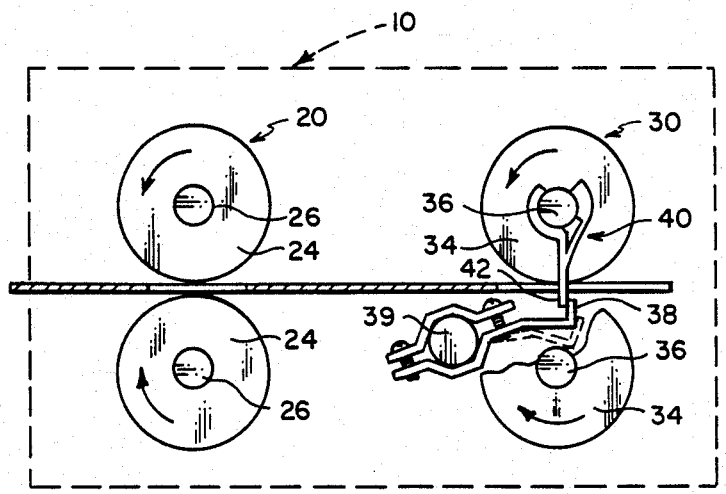
FIG. 1 is a schematic side elevational view, partly in section, showing a registration assembly with the registration gate of the present invention.

Referring now to FIG. 1 of the drawings in detail, a preferred embodiment of a registration gate of the present invention is generally designated 40 and is particularly suitable for use in the registration assembly 10 of reproduction equipment such as a copier/duplicator. The registration assembly 10 serves as a timing device for feeding sheets seriatim in a predetermined time relationship, as for example, in a copying apparatus. The sheets are timed and fed seriatim in a left-to-right direction from a sheet supply source (not shown) to a moving surface bearing a toner image that is to be transferred to the sheet.

The registration assembly 10 includes a support 15 which receives sheets fed seriatim from an upstream source (not shown) at the left of assembly 10 and defines at least a portion of a sheet travel path. A sheet advancing roller set 20 feeds sheets along the support 15 in a left-to-right direction toward a roller set 30. While only one of each roller sets 20 and 30 are shown in the drawings, at least two sets of each roller set 20 and 30 are generally provided across the width of the sheet travel path.

Each roller set 20 comprises a pair of rollers 24 located on opposite sides of support 15. The surface of each of the rollers 24 is preferably an open-celled foam material capable of developing the necessary friction force on a sheet to move the sheet without damage thereto along the portion of the sheet path defined by support 15. The rollers 24 are mounted on rotatable shafts 26 located above and below support 15.

Similarly, each roller set 30 comprises a pair of rollers 34 on opposite sides of support 15. The rollers 34 preferably are made of a foam material and cooperate to drive sheets along support 15. The rollers are mounted on rotatable drive shafts 36 that are located above and below support 15 at the same general displacements from support 15 as shafts 26. The shafts 26 are interconnected with shafts 36 by suitable means (such as a gear train, not shown) to rotate the sheet advancing roller set 20 in the same direction and at the same speed as roller set 30.

Figure 2:
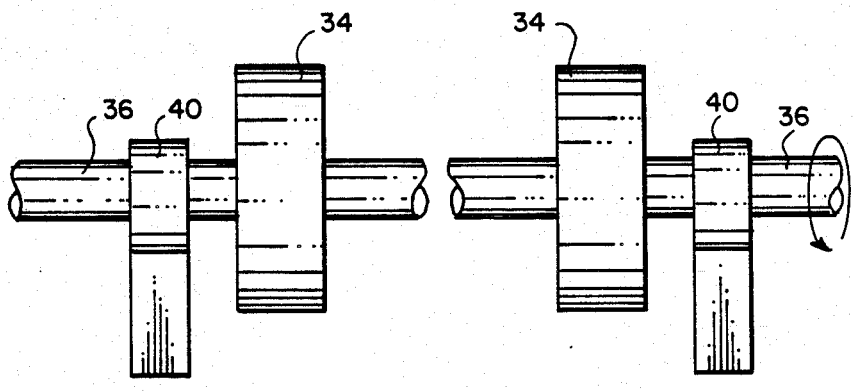
FIG. 2 is an elevational view of a part of the registration assembly showing a rotatable drive shaft with two sheet feeding rollers and two registration gates of the present invention.
Figure 4:
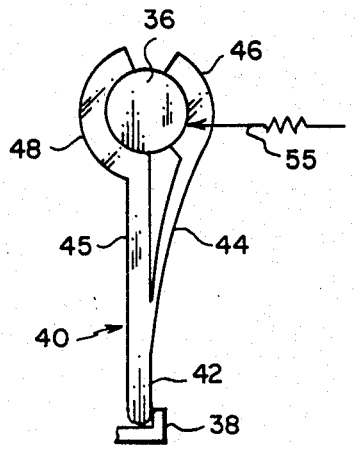
FIG. 4 is a side elevational view showing the gate on the shaft.

A plurality of the registration gates generally designated 40 are mounted on the shaft 36 above the support 15. As best shown in FIG. 2, each gate can be immediately adjacent to, but spaced from a sheet feeding roller 34. The registration gate 40 comprises a finger portion 42 at one end of the gate. The finger portion can intercept a sheet being advanced along the sheet travel path defined by support 15 when the finger portion 42 is blocked by a latching means 38 as shown in FIGS. 1 and 4. However, when the finger portion 42 is released by the latching means 38, the entire registration gate 40 can move away from the sheet path to permit advancement of a sheet along the path, as explained in more detail later. Latching means 38 is a conventional mechanism comprising a shaft 39 that selectively oscillates to move a latching member between the solid and dotted line positions as shown in FIG. 1.

Figure 3:
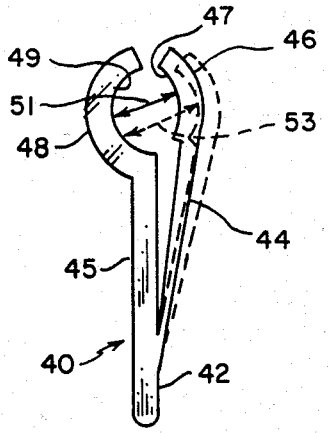
FIG. 3 is an enlarged side elevational view of the gate alone and showing in phantom the position of portions of the gate when it is mounted on the drive shaft.

The gate 40 has two jaw-like portions 46, 48 for mounting the gate 40 to the shaft 36 above the support 15. Two arm portions 44, 45 connect the finger portion 42 and the jaw-like portions 46, 48. The entire registration gate 40 of the present invention including the jaw-like portions 46, 48, the finger portion 42, and the arm portions 44, 45, preferably are integrally formed as shown in FIG. 3. For example, the entire gate 40 can be molded from a suitable plastic material.

The jaw-like portions 46 and 48 have semi-cylindrical surfaces 47, 49, respectively. Both of the surfaces 47, 49 have a radius of curvature equal to the radius of shaft 36. The portions 46 and 48 are spaced from each other, and when mounted on the shaft 36, are on opposite sides of the axis of the shaft. Before being mounted onto the shaft 36, these surfaces of these portions are spaced apart by a distance 51 which is less than the diameter of the shaft 36. However, the surfaces are spaced apart by a distance 53 equal to the diameter of the shaft 36 when the gate 40 is mounted to the shaft 36.

As shown in FIGS. 3 and 4, the two arm portions 44 and 45 connect the jaw-like portions 46 and 48 to the finger portion 42. Arm portion 44 is a thin flexible member and comprises a cantilever spring. The other arm portion 45 is thicker than arm portion 44 and is generally rigid. Arm portion 45 is integral with and connects the jaw-like portion 48 to finger portion 42. Arm portion 44 connects the jaw-like portion 46 to the finger portion. The flexible cantilever spring portion 44 permits the two jaw-like portions 46 and 48 to be separated when being mounted on or removed from the shaft 36, thereby increasing the distance between the surfaces from 51 to 53. When the entire gate 40 is mounted on the shaft 36, the flexible cantilever spring arm portion 44 also urges the jaw-like portion 46 radially towards the shaft 36 and towards the other jaw-like portion 48, for applying a normal force 55 (FIG. 4) to the shaft 36, and for holding the jaw-like portions 46 and 48 in frictional engagement against the shaft 36. In this manner, the portions 46 and 48 are urged toward each other and firmly grip shaft 36 with enough force to cause the entire gate 40 to move with the shaft 36 when the finger portion 42 is released by the latching means 38.

The flexible cantilever spring arm portion 44 enables gate 40 to be easily mounted on shaft 36 by first separating the jaw-like portions 46, 48, as shown in FIG. 3, and then moving them to a position where they straddle the shaft. Then the jaw-like portions are released and the arm portion 44 brings surfaces 47, 49 into firm frictional contact with the shaft 36 as shown in FIG. 4. Surfaces 47, 49 have the same radius of curvature as shaft 36, so substantially all of the surfaces 47, 49 contact the surface of the shaft. This large surface-to-surface contact area, together with the radial spring force 55 exerted by arm portion 44 produces enough friction between the shaft and surfaces 47, 49 to cause the entire gate to rotate with the shaft unless the finger portion 42 is prevented from rotating in that manner. When the latching means 38 holds the finger portion 42 and prevents rotation of the gate, the shaft can rotate relative to surfaces 47, 49 since the gate is only frictionally coupled to the shaft.

The operation of the registration gate 40 and registration assembly 10 will now be described.

A drive mechanism (not shown) is actuated to rotate the shafts 26, 36 and the upper rollers 24, 34 of the roller sets 20 and 30 respectively. The jaw-like portions 46 and 48 of the mounted registration gate 40, frictionally engage the shaft 36 above the support 15. The normal force 55 exerted radially by this frictional engagement, is sufficient to cause the entire gate 40 to rotate with the shaft 36 when the finger portion 42 is released by the latching means 38. However, the force 55 is weak enough to allow the gate 40 to slip relative to the shaft 36 when the finger portion 42 is prevented from rotating with the shaft, as shown in FIGS. 1 and 4, by the latching means. The engagement force 55 is also such as would allow the gate 40 to slip relative to the shaft 36 when the finger portion 42 has been released by latching means 38 and then rotated with the shaft 36 until the finger portion contacts the upper surface of a sheet being fed by the roller sets 20 and 30 past gate 40. The roller sets 20 and 30 are constantly driven even when the gate 40 is held stationary and slipping relative to the rotating shaft 36 and rollers 34.

As shown in FIG. 2, a plurality of the gates 40 are mounted on shaft 36 in spaced relation to each other. Initially, the latching means 38 for each gate is in its solid line position, as shown in FIGS. 1 and 4, where it engages the finger portion 42 and prevents the entire gate 40 from rotating with the shaft 36. The registration gates 40 thus slip relative to the shaft 36. At the appropriate time in the copying cycle of the copying apparatus, a sheet is fed from an upstream supply source (not shown) onto support 15 and advanced by the rollers 24 of the roller set 20 until the leading edge of the sheet is blocked by the registration finger portions 42. A sheet fed to roller sets 20 is thus advanced against the finger portions 42 to register the sheet and remove any misalignment thereof. As noted above, the material of the surfaces of the rollers 24 and their location relative to support 15, will enable the rollers 24, 34 to slip on a sheet in registration between roller sets 20 and 30 rather than cause such a sheet to buckle.

Each sheet, advanced by roller sets 20 and held in registration between roller sets 20 and 30 and just upstream of the nips of roller sets 30 by finger portions 42, will remain in this registration position until the finger portions 42 are released by latching means 38. The release of the finger portions 42 is timed by the rotation of a gear (not shown) interrelated to the arrival of a toner image on a moving surface at a location downstream of the registration assembly 10. The release of the finger portions is achieved by momentarily pivoting the latching means 38 clockwise to their dotted line position, as shown in FIG. 1. Because the flexible cantilever arm portion 44 of each gate is applying a normal force 55 radially to the shaft 36, this causes the gates 40 to rotate with the shaft. As the gates rotate, finger portions 42 swing out of the sheet path on support 15. This permits the sheet, previously held in registration between roller sets 20 and 30, to be advanced into the nips of the roller sets 30 for feeding by the rollers 34 downstream to the image transfer station (not shown).

As soon as the finger portions 42 move clockwise from their FIG. 1 position, the latching means 38 can be returned to their solid line position. Before the sheet being fed passes completely between the rollers 34, the finger portions 42 may come to rest on the upper surface of the sheet. If so, the jaw-like portions 46 and 48, and thus the entire gates 40 will stop rotating, while the shaft 36 continues to rotate. As soon as the sheet clears finger portions 42, the gates again rotate until the finger portions 42 engage the latching means 38. Thus the finger portions 42 are latched in their sheet registration position where they can intercept, register and align the next sheet advanced by roller sets 20. This operation is repeated for each sheet fed seriatim through the registration assembly 10.

Figure 5:
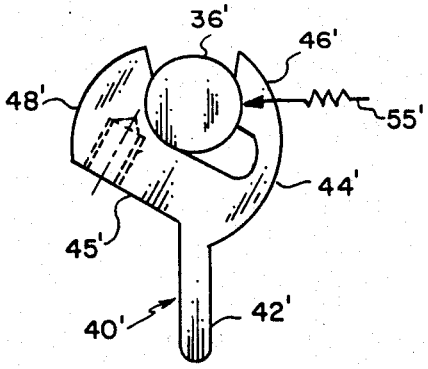
FIG. 5 is a side elevational view showing another embodiment of the gate on the shaft.

FIG. 5 illustrates another preferred embodiment of the invention. While the FIG. 5 embodiment is different in appearance, it is functionally the same as the previous embodiment. Accordingly, the parts have been designated by the same reference numerals, but with a prime (') added to each numeral.

From the foregoing, it is apparent that a novel registration gate of simple design and construction has been provided. The gate is integrally formed from only a single component that cooperates with only the drive shaft, sheet feeding rollers and latching means to function effectively. The gate also functions without the axial loading on the sheet feeding rollers 34 required by some prior mechanisms. Also, the gate is easily mounted on shaft 36 simply by spreading apart the jaw-like portions 46, 48 and snapping the gate 40 onto the shaft 36. The gate is readily adjusted axially along the shaft to the desired position without requiring movement of rollers 34, and is held on shaft 36 solely by frictional force. The gate also can be easily removed by separating the jaw-like portions 46, 48 and pulling the gate away from the shaft.

The invention has been described in detail with particular reference to preferred embodiments thereof. However, it will be understood that variations and modifications may be effected within the spirit and scope of the invention.

I claim:

1. In a sheet feeding and registration assembly, including a rotatable shaft, a sheet registration gate, and means for preventing the gate from rotating with the shaft, the improvement comprising:

means for radially mounting the gate to the rotatable shaft, said mounting means frictionally and radially engaging and loading against said shaft with a force sufficient to cause the gate to rotate with said shaft when the gate is free to rotate, but allowing relative movement between said shaft and said mounting means, when the gate is prevented from rotating with said shaft.

2. The invention as set forth in claim 1 wherein said mounting means comprises first and second portions that are spaced from each other and located on opposite sides of the axis of said shaft, and means integral with said mounting means for urging said spaced portions toward said shaft in a radial direction.

3. A sheet feeding and registration assembly having a rotatable shaft, the assembly comprising:

(a) a registration gate having:

a finger at one end of the gate for intercepting sheets being advanced along a sheet feeding path, mounting means at another end of the gate for mounting the gate to the drive shaft, means connecting said mounting means to said finger, means for urging said mounting means radially toward said shaft so as to radially load the gate into frictional engagement with the shaft; and (b) latching means for blocking the rotation of said finger thereby causing said mounting means to overcome said radial loading force and to slip relative to the shaft.

4. The invention as set forth in claim 3 wherein said connecting means comprises a pair of arm portions connected to said mounting means.

5. The invention as set forth in claim 3 wherein said urging means is a cantilever spring connected to said mounting means and said finger so as to apply a normal force to the shaft through said mounting means.

6. The invention as set forth in claim 3 wherein said mounting means, said connecting means and said finger of the registration gate are integrally formed.

* * * * *